US008353114B2

(12) United States Patent
Beers et al.

(10) Patent No.: US 8,353,114 B2
(45) Date of Patent: Jan. 15, 2013

(54) APPARATUS AND METHOD FOR REFRIGERATION CYCLE WITH AUXILIARY HEATING

(75) Inventors: David G. Beers, Elizabeth, IN (US); Brent Alden Junge, Evansville, IN (US); Nicholas Okruch, Jr., Mt. Washington, KY (US); Amelia Lear Hensley, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 417 days.

(21) Appl. No.: 12/843,148

(22) Filed: Jul. 26, 2010

(65) Prior Publication Data

US 2012/0017464 A1 Jan. 26, 2012

(51) Int. Cl.
*F26B 11/03* (2006.01)

(52) U.S. Cl. ..... 34/343; 34/595; 34/606; 68/13 R; 68/207; 8/149.3; 8/159

(58) Field of Classification Search ..... 34/380, 34/381, 339.342, 343.413, 443.444, 497, 34/595, 601, 606, 610; 68/3 R, 13 R, 58; 8/149.2, 149, 3, 159
See application file for complete search history.

(56) References Cited

U.S. PATENT DOCUMENTS 4,433,557 A * 2/1984 McAlister ..... 62/324.1
4,481,786 A * 11/1984 Bashark ..... 62/160
4,603,489 A * 8/1986 Goldberg ..... 34/77
4,621,438 A * 11/1986 Lanciaux ..... 34/77
7,010,363 B2 * 3/2006 Donnelly et al. ..... 700/19
7,020,985 B2 * 4/2006 Casey et al. ..... 34/595
7,055,262 B2 6/2006 Goldberg et al.
7,194,823 B2 * 3/2007 Nakamoto et al. ..... 34/526
7,653,443 B2 * 1/2010 Flohr ..... 700/14
7,665,227 B2 * 2/2010 Wright et al. ..... 34/339
7,735,345 B2 * 6/2010 Wright et al. ..... 68/13 R
7,766,988 B2 * 8/2010 Roberts ..... 55/385.1
7,812,557 B2 * 10/2010 Maekawa ..... 318/400.32

(Continued)

FOREIGN PATENT DOCUMENTS

DE 3543722 A1 * 10/1987

(Continued)

*Primary Examiner* — Stephen M. Gravini
(74) *Attorney, Agent, or Firm* — Global Patent Operation; Douglas D. Zhang

(57) ABSTRACT

An apparatus includes a mechanical refrigeration cycle arrangement in turn including an evaporator, a condenser, a compressor, and an expansion device, cooperatively interconnected. A drum is provided to receive clothes to be dried. An auxiliary heater is included, as is a duct and fan arrangement configured to pass air over the condenser and the heater, and through the drum. A sensor is located to sense high side temperature and/or high side pressure of the mechanical refrigeration cycle arrangement. A controller is coupled to the sensor and the auxiliary heater, and is operative to: activate the auxiliary heater during a startup transient of the mechanical refrigeration cycle arrangement; monitor the high side temperature and/or high side pressure, during the startup transient; and de-activate the auxiliary heater in response to the high side temperature and/or high side pressure reaching a first predetermined value.

18 Claims, 10 Drawing Sheets

U.S. PATENT DOCUMENTS

| | | | | |
|---|---|---|---|---|
| 7,866,061 | B2 * | 1/2011 | Tatsumi et al. | 34/595 |
| 7,908,766 | B2 * | 3/2011 | Ahn et al. | 34/595 |
| 7,921,578 | B2 * | 4/2011 | McAllister et al. | 34/597 |
| 8,132,339 | B2 * | 3/2012 | Moon et al. | 34/601 |
| 8,240,064 | B2 * | 8/2012 | Steffens | 34/480 |
| 8,245,545 | B2 * | 8/2012 | Maekawa | 68/12.16 |
| 8,266,824 | B2 * | 9/2012 | Steiner | 34/595 |
| 2008/0235977 | A1 | 10/2008 | Kuwabara | |
| 2009/0139107 | A1 | 6/2009 | Grunert et al. | |

FOREIGN PATENT DOCUMENTS

| | | | |
|---|---|---|---|
| DE | 4434205 | A1 * | 3/1996 |
| EP | 467188 | A1 * | 1/1992 |
| EP | 1209277 | A2 * | 5/2002 |
| JP | 07178289 | A * | 7/1995 |
| JP | 2004089413 | A * | 3/2004 |
| WO | WO 9405846 | A1 * | 3/1994 |
| WO | WO 2007074040 | A1 * | 7/2007 |

* cited by examiner

R 134a SATURATION CURVE

TEMPERATURE SHIFT FROM AUXILLARY HEATING CAUSES HEAT TRANSFER IMBALANCE AND MASS FLOW RESTRICTION IN CAPILLARY RESULTING IN CAPACITY INCREASE IN EVAP AND PRESSURE ELEVATION IN CONDENSER. MASS FLOW IMBALANCE IS ALSO A RESULT.

R 134a SATURATION CURVE

MASS FLOW THROUGH COMPRESSOR INCREASES DUE TO SUPERHEATING RESULTING IN FURTHER PRESSURE INCREASE IN CONDENSER. THE DYNAMIC TRANSIENT IS COMPLETED WHEN CONDENSER REESTABLISHED SUBCOOLING AND HEAT FLOW BALANCE AT HIGHER PRESSURES. THE NET EFFECT IS HIGHER AVERAGE HEAT TRANSFER DURING PROCESS MIGRATION.

APPARATUS AND METHOD FOR REFRIGERATION CYCLE WITH AUXILIARY HEATING

BACKGROUND OF THE INVENTION

The subject matter disclosed herein relates to appliances using a mechanical refrigeration cycle, and more particularly to heat pump dryers and the like.

Clothes dryers have typically used electric resistance heaters or gas burners to warm air to be used for drying clothes. These dryers typically work on an open cycle, wherein the air that has passed through the drum and absorbed moisture from the clothes is exhausted to ambient. More recently, there has been interest in heat pump dryers operating on a closed cycle, wherein the air that has passed through the drum and absorbed moisture from the clothes is dried, re-heated, and re-used.

BRIEF DESCRIPTION OF THE INVENTION

As described herein, the exemplary embodiments of the present invention overcome one or more disadvantages known in the art.

One aspect of the present invention relates to a method comprising the steps of: activating an auxiliary heater in one of a supply duct and a return duct of a heat pump clothes dryer operating on a mechanical refrigeration cycle, during a startup transient of the heat pump clothes dryer; monitoring at least one of high side temperature and high side pressure of the mechanical refrigeration cycle, during the startup transient; and de-activating the auxiliary heater in response to the at least one of high side temperature and high side pressure reaching a first predetermined value corresponding to thermodynamic elevation of the mechanical refrigeration cycle consistent with a safe operating temperature of a compressor of the mechanical refrigeration cycle.

Another aspect relates to an apparatus comprising: a mechanical refrigeration cycle arrangement in turn comprising an evaporator, a condenser, a compressor, and an expansion device, cooperatively interconnected; a drum to receive clothes to be dried; an auxiliary heater; a duct and fan arrangement configured to pass air over the condenser and the heater, and through the drum; a sensor located to sense at least one of high side temperature and high side pressure of the mechanical refrigeration cycle arrangement; and a controller coupled to the sensor and the auxiliary heater. The controller is operative to: activate the auxiliary heater during a startup transient of the mechanical refrigeration cycle arrangement; monitor the at least one of high side temperature and high side pressure, during the startup transient; and de-activate the auxiliary heater in response to the at least one of high side temperature and high side pressure reaching a first predetermined value corresponding to thermodynamic elevation of the mechanical refrigeration cycle arrangement consistent with a safe operating temperature of the compressor.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

Figure 1:
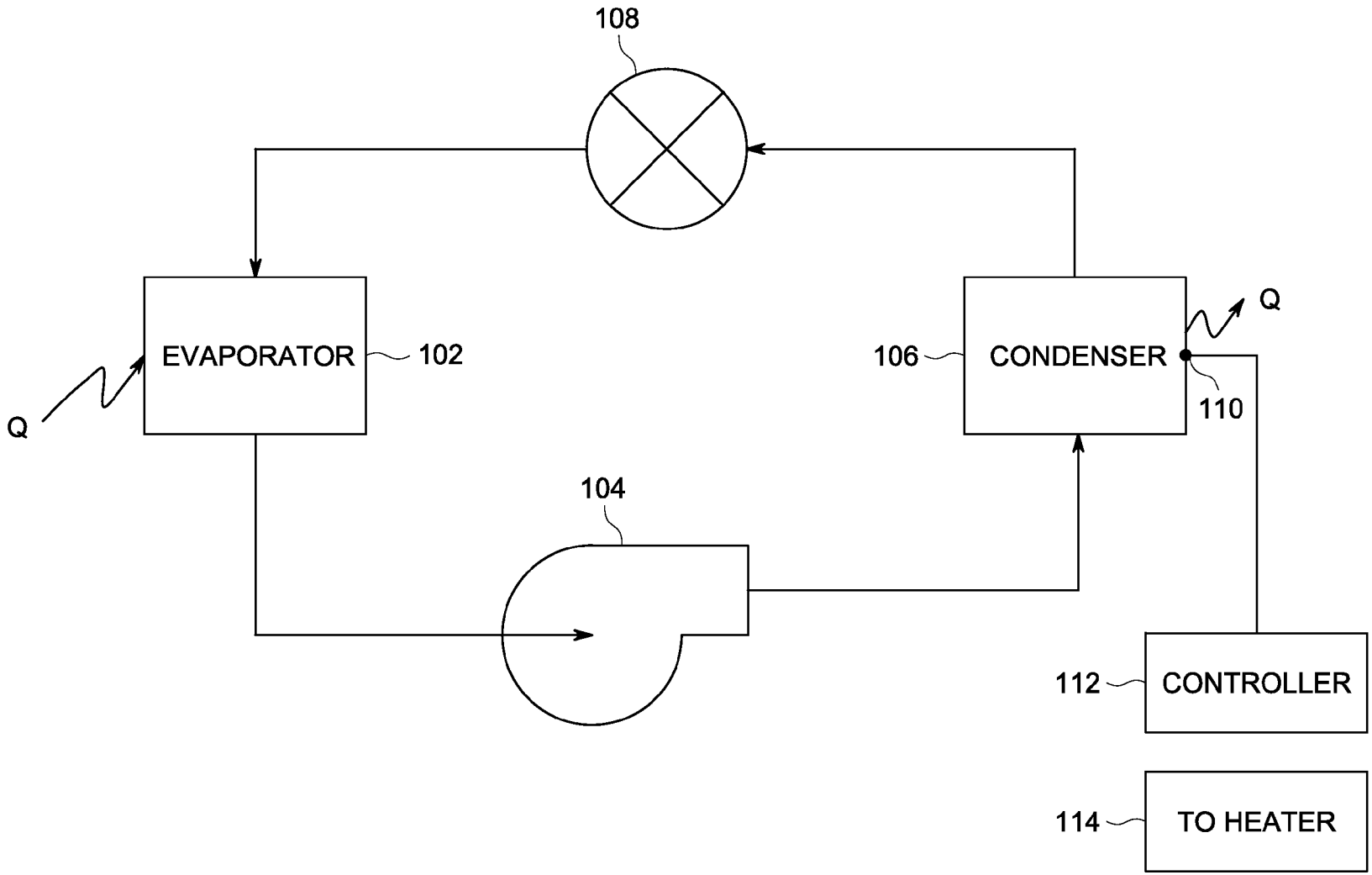
FIG. 1 is a block diagram of an exemplary mechanical refrigeration cycle, in accordance with a non-limiting exemplary embodiment of the invention.

FIG. 1 shows an exemplary embodiment of a mechanical refrigeration cycle, in accordance with an embodiment of the invention. Heat (Q) flows into evaporator 102, causing refrigerant flowing through same to evaporate and become somewhat superheated. The superheated vapor is then compressed in compressor 104, and flows to condenser 106, where heat (Q) flows out. The refrigerant flowing through condenser 106 condenses and becomes somewhat sub-cooled. It then flows through restriction 108 and back to evaporator 102, competing the cycle. In a refrigerator, freezer, or air conditioner, evaporator 102 is located in a region to be cooled, and heat is generally rejected from condenser 106 to ambient. In a heat pump, heat is absorbed from the ambient in evaporator 102 and rejected in condenser 106 to a space to be heated.

In the non-limiting exemplary embodiment of FIG. 1, a temperature or pressure sensor 110 is located in the center of the condenser 106 and is coupled to a controller 112 which, as indicated at 114, in turn controls an auxiliary heater, to be discussed in connection with FIG. 2.

In review, a mechanical refrigeration system includes the compressor 104 and the restriction 108 (either a capillary or a thermostatic expansion valve or some other kind of expansion valve or orifice—a mass flow device just before the evaporator 102 which limits the mass flow and produces the pressures in the low side and high side). The condenser 106 and the evaporator 102 are heat exchange devices and they regulate the pressures. The mass transfer devices 104, 108 regulate the mass flow. The pressure in the middle of the condenser 106 will be slightly less than at the compressor outlet due to flow losses.

Figure 2:
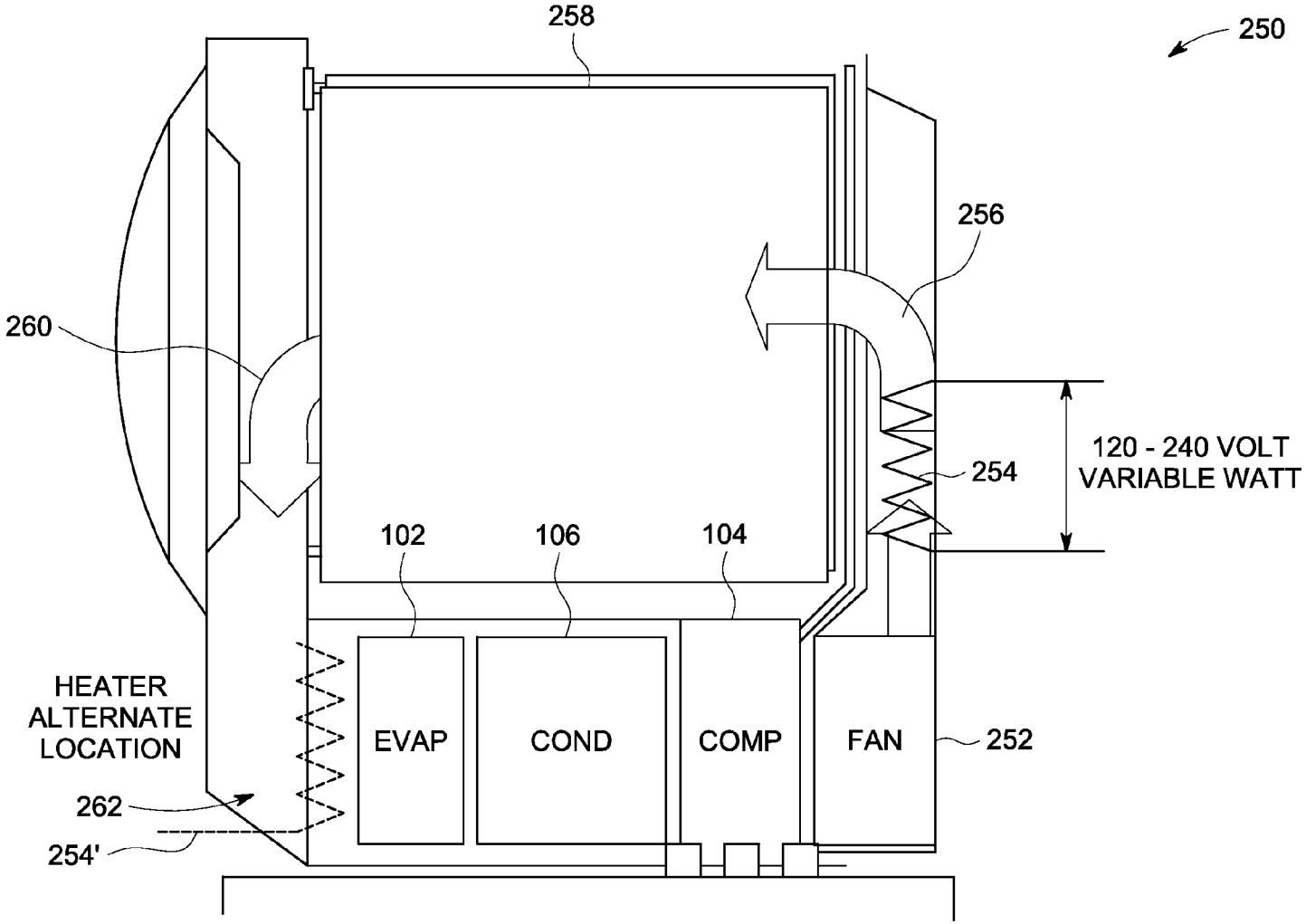
FIG. 2 is a semi-schematic side view of a heat pump dryer, in accordance with a non-limiting exemplary embodiment of the invention.

FIG. 2 shows an exemplary embodiment of a heat pump type clothes dryer 250. The evaporator 102, condenser 106, and compressor 104 are as described above with respect to FIG. 1. The refrigerant lines and the expansion valve 108 are omitted for clarity. Fan 252 circulates air through a supply duct 256 into drum 258 to dry clothes contained therein. The mechanism for rotating the drum 258 can be of a conventional kind and is omitted for clarity. Air passes through the drum 258 into a suitable return plenum 260 and then flows through a return duct 262. Condenser 106 is located in the air path to heat the air so that it can dry the clothes in the drum 258.

One or more embodiments include an auxiliary heater 254 in supply duct 256 and/or an auxiliary heater 254' in return duct 262; in either case, the heater may be controlled by controller 112 as discussed elsewhere herein.

One or more embodiments advantageously improve transient performance during start-up of a clothes dryer, such as dryer 250, which works with a heat pump cycle rather than electric resistance or gas heating. As described with respect to 254, 254', an auxiliary heater is placed in the supply and/or return duct and used to impact various aspects of the startup transient in the heat pump drying cycle.

With continued reference to FIG. 1, again, compressor 104 increases the pressure of the refrigerant which enters the condenser 106 where heat is liberated from the refrigerant into the air being passed over the condenser coils. The fan 252 passes that air through the drum 258 to dry the clothes. The air passes through the drum 258 to the return duct 262 and re-enters or passes through the evaporator 102 where it is cooled and dehumidified (this is a closed cycle wherein the drying air is re-used). In some instances, the heater can be located as at 254, in the supply duct to the drum (after the fan 252 or between the condenser 106 and the fan 252). In other instances, the heater can be located at point 254', in the return duct from the drum 258, just before the evaporator 102.

Thus, one or more embodiments place a resistance heater of various wattage in the supply or return duct of a heat pump dryer to provide an artificial load through the drum 258 to the evaporator 102 by heating the supply and therefore the return air, constituting a sensible load to the evaporator 102 before the condenser 106 is able to provide a sensible load or the clothes load in drum 258 is able to provide a latent psychrometric load. This forces the system to develop higher temperatures and pressures earlier in the run cycle, accelerating the onset of drying performance.

A refrigeration system normally is run in a cycling mode. In the off cycle it is allowed to come to equilibrium with its surroundings. A system placed in an ambient or room type environment will seek room temperature and be at equilibrium with the room. When the system is subsequently restarted, the condenser and evaporator will move in opposite directions from the equilibrium pressure and temperature. Thus, the evaporator will tend towards a lower pressure and/or temperature and the condenser will seek a higher temperature and/or pressure. The normal end cycle straddles the equilibrium pressure and steady state is reached quite quickly.

In one or more embodiments, for system efficiency in a heat pump dryer, operating points that result in both the condenser and evaporator pressures and temperatures being above the equilibrium pressure of the system in the off mode are sought.

Figure 3:
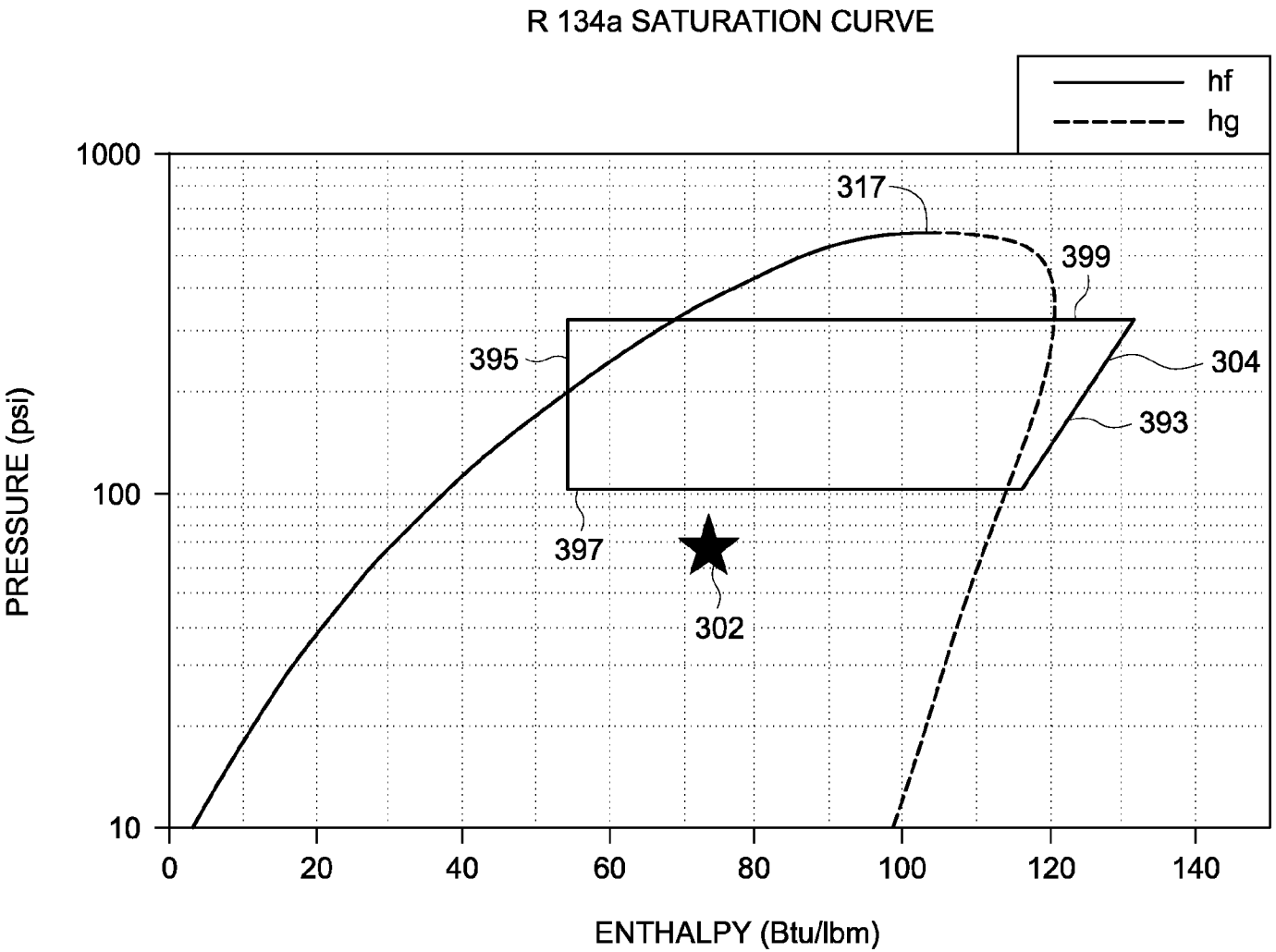
FIGS. 3 and 4 are pressure-enthalpy diagrams illustrating refrigerant cycle elevation, in accordance with a non-limiting exemplary embodiment of the invention.
Figure 4:
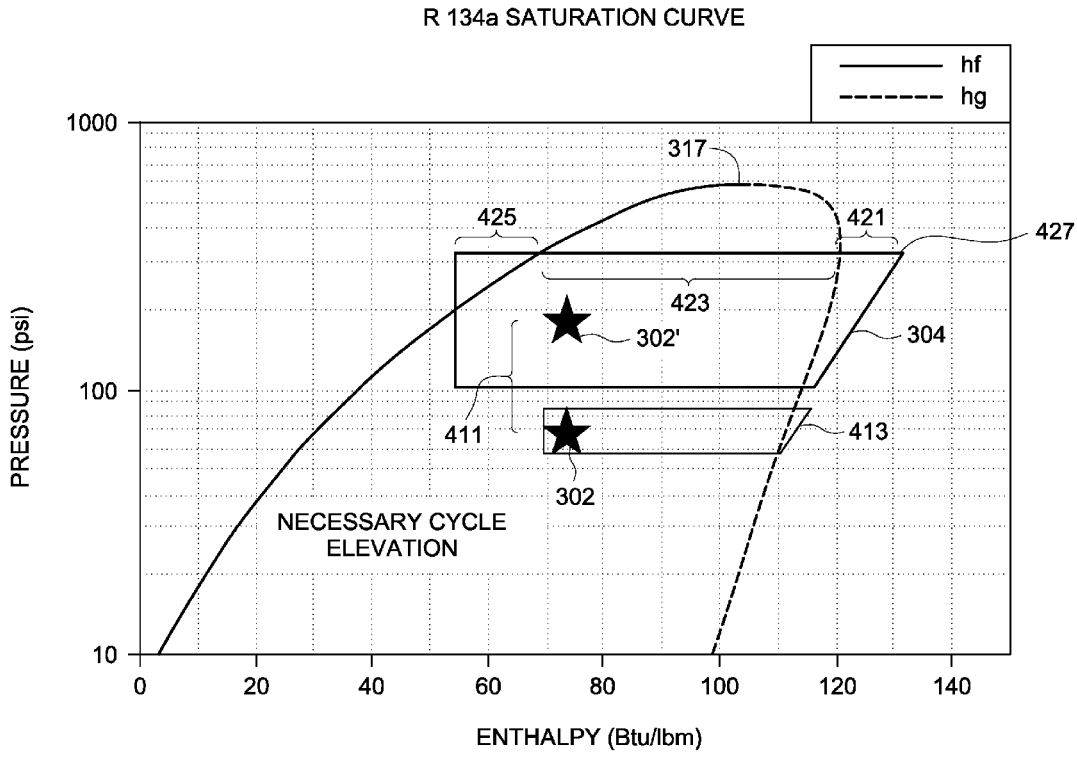

Placing a heater in the supply duct to the drum of a heat pump dryer heats the air up well above ambient temperature as it is presented to the evaporator. If the heater is on at the start of a drying cycle the heat serves to begin the water extraction process in the clothes by evaporation in combination with the airflow by diffusion. The fact that more water vapor is in the air, and the temperature is higher than would otherwise be the case, causes the evaporator to "see" higher temperature than it would otherwise "see." The temperature of the evaporator will elevate to meet the perceived load, taking the pressure with it. Thus the temperature and pressure of the refrigerant are elevated above the ambient the refrigerant would otherwise seek as shown in FIGS. 3 and 4 and described in greater detail below.

With each subsequent recirculation of the air, a higher level is reached until leakage and losses neutralize the elevating effects. Since a suitably sealed and insulated system will not lose the accumulated heat, the cycle pressure elevation can continue until a quite high pressure and temperature are reached. Thus, the refrigeration system moves into a regime where compressor mass flow is quite high and power consumed is quite low.

With the heater on, the system moves to a higher total average pressure and achieves such a state considerably faster than in a conventional system. This is brought about by supplying the evaporator a definite and instantaneous load. This loading causes the heat exchangers (i.e., evaporator 102 and condenser 106) to react and supply better properties to accelerate mass flow through the mass flow devices (the compressor 104 and restrictor 108).

Elevation of a refrigerant cycle's pressures within the tolerance limits of the refrigerant boosts compressor capacity at approximately equal power consumption. Thus, in one or more embodiments, the efficiency of refrigeration cycles is improved as pressures are elevated.

Given the teachings herein, the skilled artisan will be able to install, control, and protect a suitable heater with minimal cost, and will also be able to interconnect the heater with the control unit for effective control.

Refer to the P-h (pressure-enthalpy) diagram of FIG. 3. The star 302 represents the equalization condition. In refrigerators and other refrigeration devices such as air conditioners, dehumidifiers, and the like, a cycle is typically started up around the equalization point. When the compressor starts, it transfers mass from the evaporator or low pressure side, to the high pressure side (condenser). The condenser rejects heat and the evaporator absorbs heat, as described above. Generally, the source temperatures for the heat exchangers are found inside the cycle curve 304. The diagram of FIG. 3 illustrates, rather than lowering (the evaporator pressure) and raising (the condenser pressure) pressures from equilibrium, elevating the cycle 304 completely (i.e., both low 397 and high 399 pressure sides) above the equalization pressure at star 302. To accomplish this, provide the aforementioned auxiliary heat source to raise the cycle to a different starting state by preloading the evaporator and causing the system to migrate to a higher pressure-temperature cycle.

Refer now to the P-h diagram of FIG. 4. The necessary cycle elevation is given by the bracket 411 between the two stars 302, 302'. Typically, the system will start in a cycle 413 surrounding the equalization point, which is the lower star 302. Because of the auxiliary heater (which in one or more embodiments need provide only a faction of the power actually needed to dry the clothes), the cycle elevates and spreads to the desired upper envelope 304. By way of review, if the auxiliary heater was not applied, operation would be within the lower cycle 413 wherein, shortly after startup, the upper pressure is between 80 and 90 PSI and the lower pressure is between 50 and 60 PSI. Note that these values would eventually change to an upper pressure of about 150 PSI and a lower pressure of about 15 PSI when a steady state was reached. Thus, without the extra heater, the steady state cycle obtained would have a high side pressure of about 150 PSI and a low side pressure of about 15 PSI. Upper envelope 304 shows the results obtained when the auxiliary heater is used. Eventually, the auxiliary heater is preferably shut off to prevent the compressor overheating. Thus, for some period of time during the startup transient, apply extra heat with the auxiliary heater, causing the heat pump to operate in a different regime with a higher level of pressure.

For completeness, note that upper envelope 304 represents, at 393, a compression in compressor 104; at high side 399, condensation and sub-cooling in condenser 106; at 395, an isenthalpic expansion through valve 108, and at low side 397, evaporation in evaporator 102. Enter the condenser as a superheated vapor; give up sensible heat in region 421 until saturation is reached, then remain saturated in region 423 as the quality (fraction of the total mass in a vapor-liquid system that is in the vapor phase) decreases until all the refrigerant has condensed; then enters a sub-cooled liquid region 425.

Heretofore, it has been known to place resistance heaters in the supply (but not return) ducts of heat pump dryers simply to supplement the action of the condenser in heating and drying the air. However, one or more embodiments of the invention control the heater to achieve the desired thermodynamic state of the refrigeration cycle and then shut the heater off at the appropriate time (and/or cycle the heater). With reference to FIG. 4, $h_f$ and $h_g$ are, respectively, the saturated enthalpies of the fluid and gas. When operating at full temperature and pressure, the high side 399 (line of constant pressure) is at approximately 300 PSI, which is very close to the top 317 of the vapor dome curve. At such point, effectiveness of the heat exchanger will be lost, so it is not desirable to keep raising the high side pressure.

Furthermore, at these very high pressures, the compressor is working very hard and may be generating so much heat at the power at which it is running that the compressor temperature increases sufficiently that the thermal protection device on the compressor shuts the compressor off. In one or more embodiments, employ a sensor 110, such as a pressure transducer and/or a thermal measurement device (e.g., a thermocouple or a thermistor) and monitor the high side temperature and/or the high side pressure. When they reach a certain value which it is not desired to exceed, a controller 112 (for example, an electronic control) turns the heater off.

To re-state, a pressure transducer or a temperature sensor is located in the high side, preferably in the middle of the condenser (but preferably not at the very entrance thereof, where superheated vapor is present, and not at the very outlet thereof, where sub-cooled liquid is present). The center of the condenser is typically operating in two phase flow, and other regions may change more quickly than the center of the condenser (which tends to be quite stable and repeatable). Other high side points can be used if correlations exist or are developed, but the center of the condenser is preferred because of its stability and repeatability (that is, it moves up at the rate the cycle is moving up and not at the rate of other transients associated with the fringes of the heat exchanger). Thus, one or more embodiments involve sensing at least one of a high side temperature and a high side pressure; optionally but preferably in the middle of the condenser.

Comments will now be provided on the exemplary selection of the pressure or temperature at which the auxiliary heater is turned off. There are several factors of interest. First, the compressor pressure can reach almost 360 or 370 PSI, and the compressor will still function, before generating enough heat such that the thermal protection device shuts it off, as described above. This, however, is typically not the limiting condition; rather, the limiting condition is the oil temperature. The compressor lubricating oil begins to break down above about 220 degrees F (temperature of the shell, oil sump, or any intermediate point in the refrigerant circuit). Initially, the oil will generate corrosive chemicals which can potentially harm the mechanism; furthermore, the lubricating properties are lost, which can ultimately cause the compressor to seize up. In one or more embodiments, limit the condenser mid temperature to no more than 190 degrees F, preferably no more than 180 degrees F, and most preferably no more than 170 degrees F. In this manner, when the heater is shut off, the compressor will stabilize at a point below where any of its shell or hardware temperatures approach the oil decomposition temperature. With regard to discharge temperature, note that point 427 will typically be about 210 degrees F. when the high side pressure is at about 320 PSI. The saturation temperature at that pressure (middle of the condenser) will be about 170 degrees F. and therefore control can be based on the mid-condenser temperature. The compressor discharge 427 is typically the hottest point in the thermodynamic cycle. The discharge is a superheated gas. The discharge gas then goes through a convective temperature change (FIG. 4 reference character 421 temperature drop) until the constant "condensing temperature" is reached. This is most accurately measured in the center of the condenser. Oil is heated by contact with the refrigerant and by contact with metal surfaces in the compressor. Generally the metal parts of the inside of the compressor run 20-30 degrees F. above the hottest point measured on the outside. The actual temperature to stay below is, in one or more embodiments, 250 degrees F. Thus, there is about a 10 degree F. margin worst case. In one or more embodiments, when the cycle is run up to this point, the maximum capacity is obtained at minimum energy, without causing any destructive condition in the compressor. Heretofore, compressors have not been operated in this region because compressor companies typically will not warrant their compressors in this region.

As noted, prior techniques using a heater do so to provide auxiliary drying capacity, not for system operating point modification, and do not carry out any sensing to turn the heater off. One or more embodiments provide a sensor 110 and a controller 112 that shut off the heater 254, 254' at a predetermined point, as well as a method including the step of shutting off the heater at a predetermined point.

Any kind of heater can be used. Currently preferred are twisted Nichrome wire (nickel-chromium high-resistance heater wire) ribbon heaters available from industrial catalogs, commonly used in hair dryers and the like.

Figure 5:
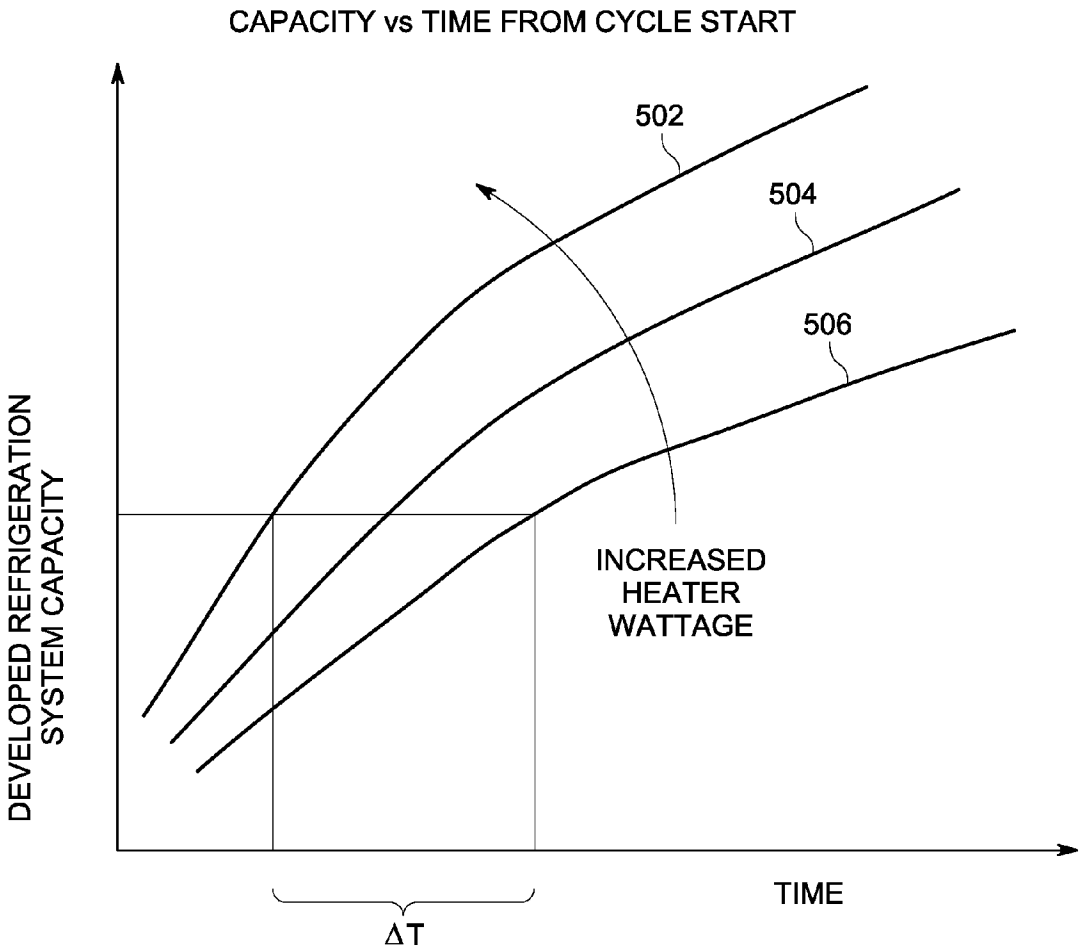
FIG. 5 presents capacity rise curves for a refrigeration system operating at elevated state points, in accordance with a non-limiting exemplary embodiment of the invention.

With the desired ending cycle for a heat pump dryer at a significant elevation above the normal air conditioning state points the transient for cycle elevation is quite long. The application of an external heater 254, 254' accelerates that transient. The observed effect is directly proportional to heater power. That is, the more power input to the auxiliary heater, the faster effective capacity and total system capacity are developed. Refer to FIG. 5, which depicts capacity rise curves of a refrigeration system operating at elevated state points with an auxiliary heater in the air circuit. The rate of capacity rise is proportional to power applied.

The faster onset of effective capacity accelerates the drying process and reduces drying time. With the heater on, the system not only moves to a higher total average pressure (and thus temperature), but also gets there significantly faster.

Thus, in one or more embodiments, application of an independent heat source to a heat pump airside circuit accelerates the progress of a refrigeration system to both effective capacity ranges and final desired state points.

Any one, some, or all of four discrete beneficial effects of the auxiliary heater can be realized in one or more embodiments. These include: (1) total amount of heat transfer attainable; (2) rate at which system can come up to full capacity; (3) cycle elevation to obtain a different state than is normally available; and (4) drying cycle acceleration.

With regard to point (2), capacity, i.e., the time it takes to get to any given capacity—it has been found that this is related to the heater and the size of the heater. In FIG. 5, time is on the lower (X) axis and capacity is on the vertical (Y) axis. Recall that with the heater elevating the system operating point, it is possible to operate at 2-3 times the rated value. The rated power of a compressor is determined by running a high back pressure compressor (air conditioning) typically at about 40 degrees F. evaporating temperature and about 131 degrees F. condensing temperature. At this rating point the rated value for an exemplary compressor is about 5000 or 7000 Btu/hr. Elevated pressures in accordance with one or more embodiments will make the compressor able to pump about 12000 or 15000 Btu/hr. This is why it is advantageous to elevate the system operating state points, to get the extra capacity. The power (wattage) of the heater also determines how fast these extra-rated values can be obtained. FIG. 5 shows the start-up curves of developed capacity versus time. With the heater in the system, it is possible to obtain more capacity faster by increasing the heater wattage.

One aspect relates to the final selection of the heater component to be installed in the drier. Thus, one or more embodiments provide a method of sizing a heater for use in a heat pump drier. The capacity ("Y") axis reads "developed refrigeration system capacity" as it does not refer to the extra heating properties of the heater itself, but rather how fast the use of the heater lets the refrigerant system generate heating and dehumidifying capacity. Prior art systems dry clothes with the electric heat as opposed to accelerating the refrigerating system coming up to full capacity. The size of the heater that is eventually chosen can help determine how fast the system achieves full capacity—optimization can be carried out between the additional wattage of the heater (and thus its power draw) and the capacity (and power draw) of the refrigeration system. There will be some optimum; if the heater is too large, while the system will rapidly come up to capacity, more total energy will be consumed than at the optimum point, due to the large heater size, whereas if the heater is too small, the system will only slowly come up to capacity, requiring more power in the refrigeration system, and again more energy will be consumed than at the optimum point. This effect can be quantified as follows. The operation of the heater involves adding power consumption for the purpose of accelerating system operation to minimize dry time. It has been determined that, in one or more embodiments, there does not appear to be a point at which the energy saved by shortening the dry time exceeds the energy expended in the longer cycle. Rather, in one or more embodiments, the total power to dry, over a practical range of heater wattages, monotonically increases with heater power rating while the efficiency of the unit monotonically decreases with heater wattage. That is to say that, in one or more embodiments, the unit never experiences a minima where the unit saves more energy by running a heater and shortening time rather than not. Thus, in one or more embodiments, the operation of a heater is a tradeoff based on desired product performance of dry time vs. total energy consumption.

In another aspect, upper line 502 represents a case where compressor power added to heater power is greater than the middle line 504. Lower line 506 could represent a case where compressor power plus heater power is less than middle line 504 but the time required to dry clothes is too long. Center line 504 represents an optimum of shortest time at minimum power. In other words, for curve 504, power is lowest for maximum acceptable time. Lower line 506 may also consume more energy, as described above, because the compressor would not be operating as efficiently.

Figure 6:
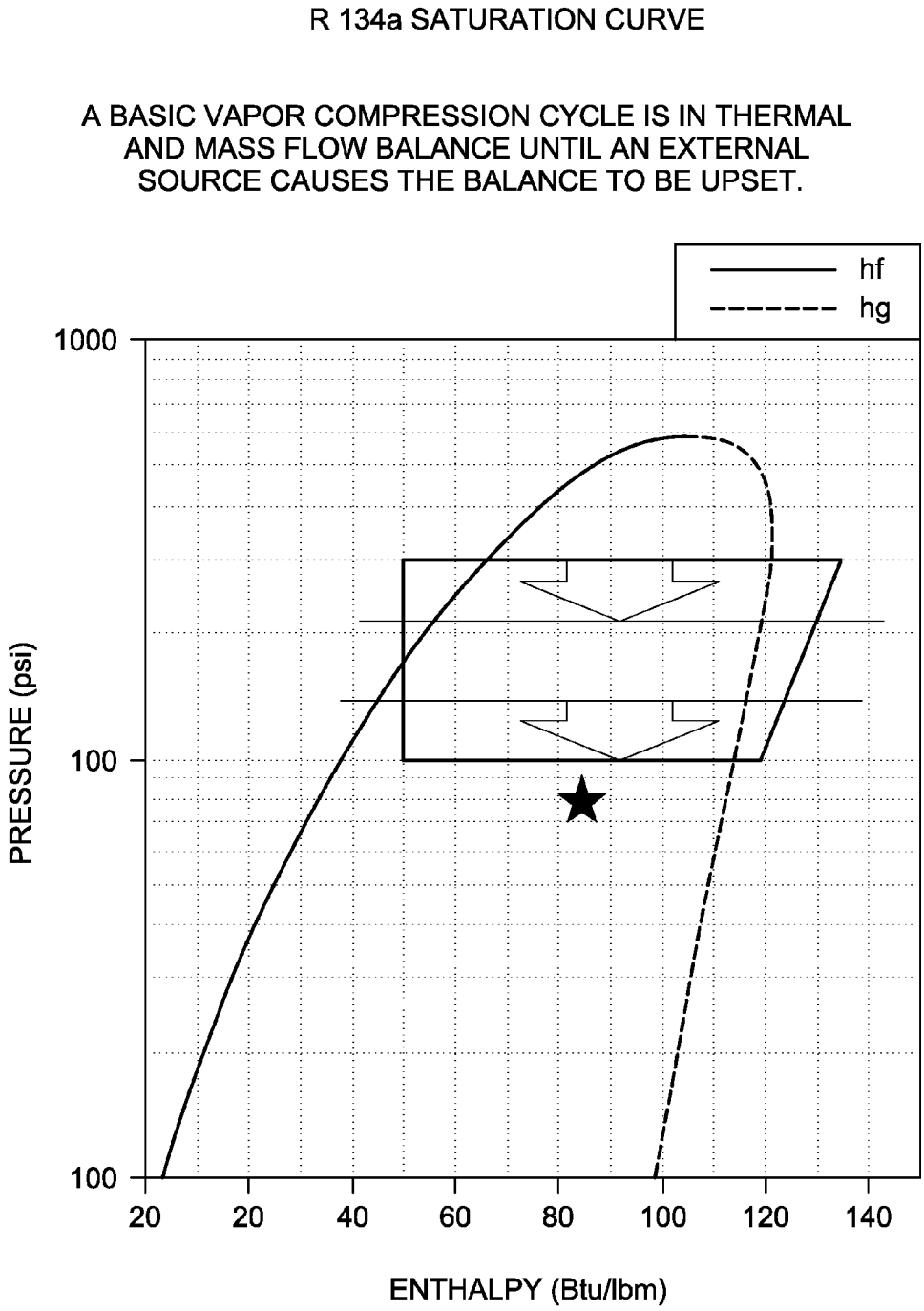
FIGS. 6-8 are pressure-enthalpy diagrams illustrating capacity enhancement, in accordance with a non-limiting exemplary embodiment of the invention.

As shown in FIG. 6, a basic vapor compression cycle is in thermal and mass flow balance until an external source causes the balance to be upset.

Figure 7:
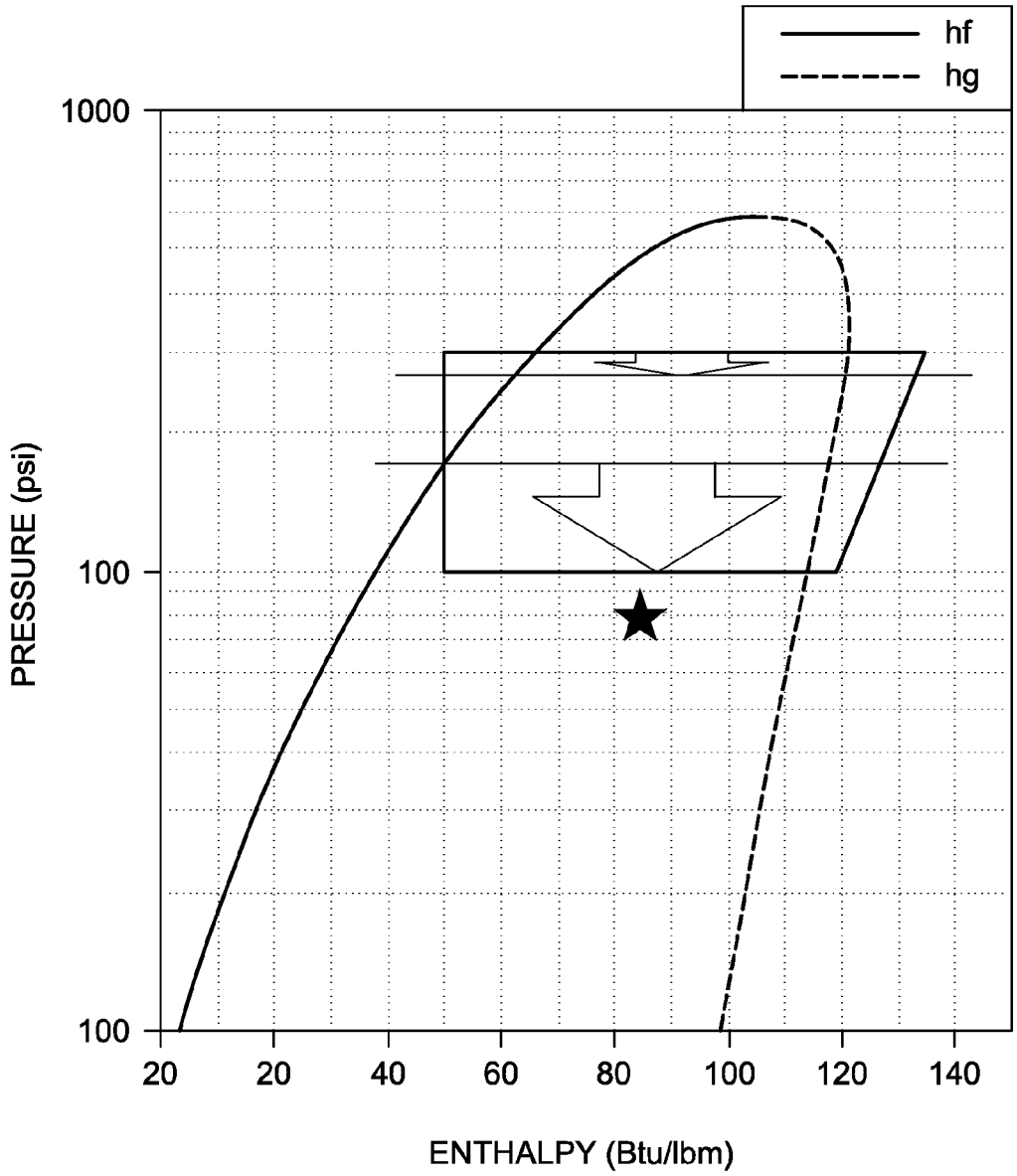

The temperature shift from auxiliary heating causes heat transfer imbalance and mass flow restriction in the capillary (or other expansion valve) resulting in capacity increase in the evaporator and pressure elevation in the condenser. Mass flow imbalance is also a result, as seen in FIG. 7, which depicts the imbalance created by additional heat input at the evaporator by raised return temperature.

Figure 8:
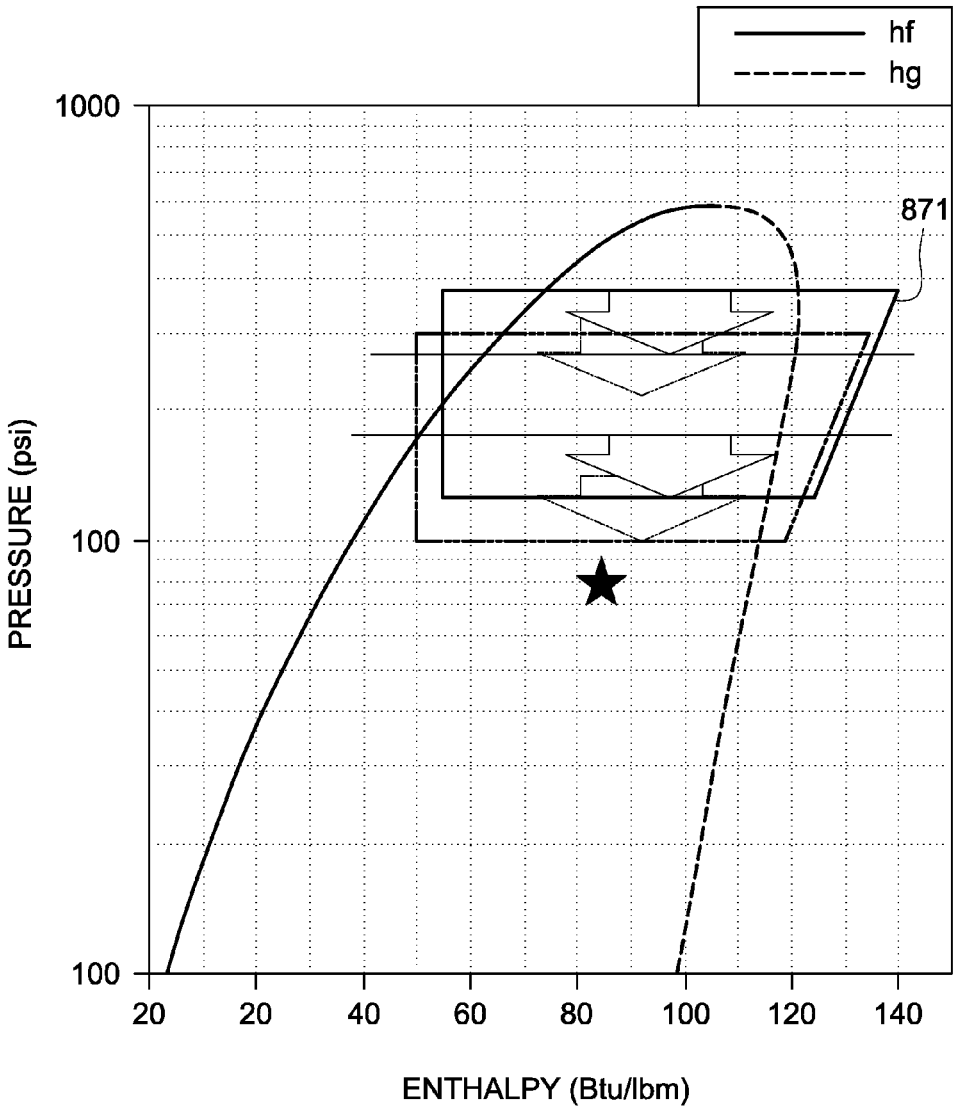

Mass flow through the compressor increases due to superheating resulting in further pressure increase in the condenser. The dynamic transient is completed when the condenser reestablishes sub-cooling and heat flow balance at higher pressures. The net effect is higher average heat transfer during process migration. FIG. 8 shows thermal and mass flow equilibrium reestablished at higher state points after the heat input transient.

One or more embodiments thus enable an imbalance in heat exchange by apparently larger capacity that causes more heat transfer to take place at the evaporator. The imbalance causes an apparent rise in condenser capacity in approximately equal proportion as the condensing pressure is forced upward. The combined effect is to accelerate the capacity startup transient inherent in heat pump dryers.

Experimentation has demonstrated the effect of capacity augmentation through earlier onset of humidity reduction and moisture collection in a run cycle.

Referring again to FIGS. 6-8, via the elevated cycle, it is possible to increase the capacity, inasmuch as the temperature shift from auxiliary heating causes heat transfer imbalance and mass flow restriction in the capillary (or other expansion valve) resulting in capacity increase in the evaporator and pressure elevation in the condenser. Mass flow imbalance is also a result. Furthermore, mass flow through the compressor increases due to superheating, resulting in further pressure increase in the condenser. The dynamic transient is completed when the condenser re-establishes sub-cooling and heat flow balance at higher pressures. The net effect is higher average heat transfer during process migration.

Heat is transferred by temperature difference (delta T). The high-side temperature 871 is at the top of the cycle diagram in FIG. 8. When that temperature is elevated, there is a larger delta T between the sink temperature (air to which heat is being rejected) and the actual temperature of the heat exchanger (condenser) itself. The imbalance caused by the auxiliary heater increases delta T and thus heat transfer which creates an apparent increase in capacity above that normally expected at a given condensing pressure or temperature. The effect is analogous to a shaker on a feed bowl; in effect, the heater "shakes" the refrigeration system and makes the heat move more efficiently. Again, it is to be emphasized that this is a thermodynamic effect on the heat pump cycle, not a direct heating effect on the clothes.

One or more embodiments of the invention pulse or cycle a heater in a heat pump clothes dryer to accomplish control of the heat pump's operating point. As noted above, placing a resistance heater of various wattage in the supply and/or return ducts of a heat pump dryer provides an artificial load through the drum to the evaporator by heating the supply and therefore the return air, constituting an incremental sensible load to the evaporator. This forces the system to develop higher temperatures and pressures that can cause the cycle to elevate continuously while running. In some embodiments, this can continue well past the time when desired drying performance is achieved. When the heater is turned off during a run cycle the cycle tends to stabilize without additional pressure and/or temperature rise, or even begin to decay. If the system operating points decay the original growth pattern can be repeated by simply turning the heater back on. Cycling such a heater constitutes a form of control of the capacity of the cycle and therefore the rate of drying.

As noted above, for system efficiency in a heat pump dryer, seek operating points that result in both the condenser and evaporator well above the equilibrium pressure of the system in off mode. In one or more embodiments, this elevation of the refrigeration cycle is driven by an external forcing function (i.e., heater 254, 254').

Further, in a normal refrigeration system, the source and sink of the system are normally well established and drive the migration to steady state end points by instantly supplying temperature differences. Such is not the case with a heat pump dryer, which typically behaves more like a refrigerator in startup mode where the system and the source and sink are in equilibrium with each other.

As noted above, with each subsequent recirculation of the air, a higher cycle level is reached until leakage and losses neutralize the elevating effects. Since a properly sealed and insulated system will not lose this accumulated heat, the cycle pressure elevation can continue until quite high pressure and temperature are reached. Thus, the refrigeration system moves into a regime where compressor mass flow is quite high and power consumed is quite low. However, a properly sealed and insulated system will proceed to high enough head pressures to shut off the compressor or lead to other undesirable consequences. In one or more embodiments, before this undesirable state is reached, the heater is turned off, and then the system states begin to decay and or stabilize. In one or more embodiments, control unit 112 controls the heater in a cycling or pulse mode, so that the system capacity can essentially be held constant at whatever state points are desired.

One or more embodiments thus provide capacity and state point control to prevent over-temperature or over-pressure conditions that can be harmful to system components or frustrate consumer satisfaction.

Figure 9:
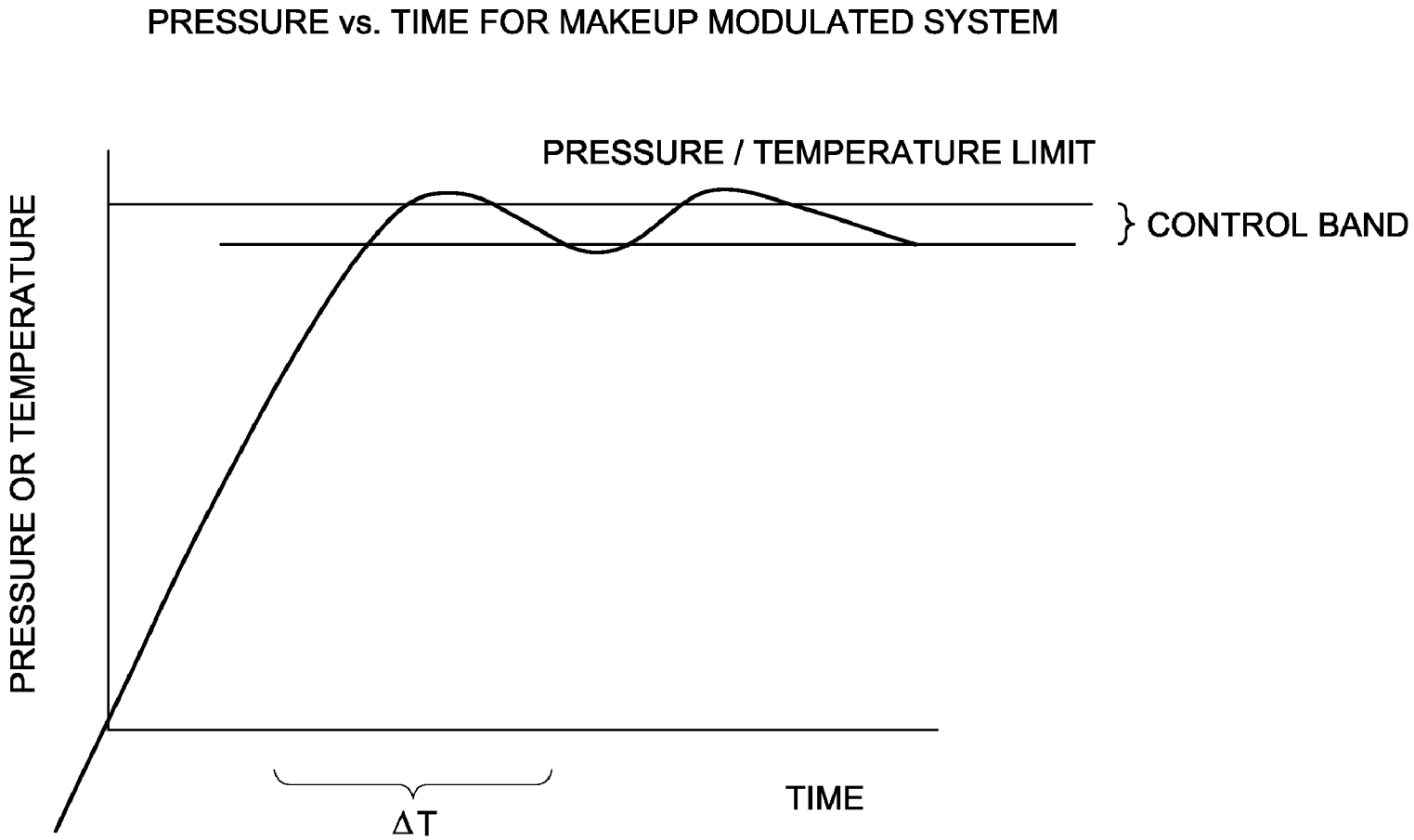
FIG. 9 presents pressure versus time for a cycle wherein an auxiliary heater is pulsed, in accordance with a non-limiting exemplary embodiment of the invention.

With reference now to FIG. 9, it is possible to accelerate the time in which the system comes up to full capacity. Once the system comes up to full capacity, then it is desired to ensure that the compressor is not overstressed. In some embodiments, simply turn off the heater when the temperature and/or pressure limits are reached (e.g., above-discussed temperature limits on compressor and its lubricant). In other cases, the heater can be cycle back on and off during the drying cycle. In the example of FIG. 9, the heater is cycled within the control band to keep the system at an elevated state.

Accordingly, some embodiments cycle the heater to keep the temperature elevated to achieve full capacity. By way of review, in one aspect, place a pressure or temperature transducer in the middle of the condenser and keep the heater on until a desired temperature or pressure is achieved. In other cases, carry this procedure out as well, but selectively turn the heater back on again if the temperature or pressure transducer indicates that the temperature or pressure has dropped off.

Determination of a control band is based on the sensitivity of the sensor, converter and activation device and the dynamic behavior of the system. These are design activities separate from the operation of the principle selection of a control point. Typically, in a control, a desired set point or comfort point is determined (e.g., 72 degrees F. for an air conditioning application). Various types of controls can be employed: electro-mechanical, electronic, hybrid electro-mechanical, and the like; all can be used to operate near the desired set or comfort point. The selection of dead bands and set points to keep the net average temperature at the desired value are within the capabilities of the skilled artisan, given the teachings herein. For example, an electromechanical control for a room may employ a 7-10 degree F. dead band whereas a 3-4 degree F. dead band might be used with an electronic control. To obtain the desired condenser mid temperature, the skilled artisan, given the teaching herein, can set a suitable control band. A thermistor, mercury contact switch, coiled bimetallic spring, or the like may be used to convert the temperature to a signal usable by a processor. The activation device may be, for example, a TRIAC, a solenoid, or the like, to activate the compressor, heater, and so on. The dynamic behavior of thermal systems may be modeled with a second order differential equation in a known manner, using inertial and damping coefficients. The goal is to cycle the auxiliary heater during operation to protect the compressor oil from overheating.

One advantage that may be realized in the practice of some embodiments of the described systems and techniques is reduction in the startup transient (e.g., lag in effective dehumidification effect) by the inertia of ambient conditions on the operation of a vapor compression refrigeration system (used, for example, in a heat pump type clothes dryer). Another advantage that may be realized in the practice of some embodiments of the described systems and techniques is that the compressor operates at a lower pressure ratio and a higher evaporating pressure, and therefore, much higher capacity than would normally be available; for instance, by way of example and not limitation, a compressor nominally rated at about 7,000 BTU/hr (or about 2000 W), when operating in the elevated cycle as described with respect to FIG. 4, can produce almost 15,000 BTU/hr. or about 5 kW. Still another advantage that may be realized in the practice of some embodiments of the described systems and techniques is about a 15-25% reduction in dry time as the start-up transient is reduced. Yet another advantage that may be realized in the practice of some embodiments of the described systems and techniques is enhanced condenser heat transfer due to higher delta T with ambient.

Given the discussion thus far, it will be appreciated that, in general terms, an exemplary method, according to one aspect of the invention, includes the step of activating an auxiliary heater 254, 254' in one of a supply duct 256 and a return duct 262 of a heat pump clothes dryer operating on a mechanical refrigeration cycle, during a startup transient of the heat pump clothes dryer. An additional step includes monitoring at least one of high side temperature and high side pressure of the mechanical refrigeration cycle, during the startup transient. A further step includes de-activating the auxiliary heater in response to the high side temperature and/or high side pressure reaching a first predetermined value corresponding to thermodynamic elevation of the mechanical refrigeration cycle consistent with a safe operating temperature of the compressor 104 of the mechanical refrigeration cycle.

In some instances, for example, as described with respect to FIG. 9, additional steps include monitoring the high side temperature and/or high side pressure of the mechanical refrigeration cycle, during steady-state operation of the heat pump clothes dryer; and periodically re-activating the auxiliary heater during the steady-state operation of the heat pump clothes dryer, responsive to the high side temperature and/or pressure declining to a second predetermined value, to at least partially maintain the thermodynamic elevation of the mechanical refrigeration cycle consistent with the safe operating temperature of the compressor of the mechanical refrigeration cycle, during the steady-state operation of the heat pump clothes dryer.

In a preferred but non-limiting approach, the monitoring is carried out with a sensor 110 located in a mid-point region of the condenser 106 of the mechanical refrigeration cycle.

In some instances, the first predetermined value is correlated to an upper safe temperature value for lubricating oil of the compressor (for example, about 220 degrees Fahrenheit, as discussed above).

To determine the relationship between the sensed mid-condenser temperature and safe oil temperature, observations can be made during the course of normal testing by placing thermocouples or the like in candidate locations.

In some instances, in the de-activating step, the thermodynamic elevation of the mechanical refrigeration cycle is such that both the high side pressure 399 and the low side pressure 397 of the mechanical refrigeration cycle are greater than an equilibrium pressure of the mechanical refrigeration cycle in off mode 302. For example, the high side pressure 399 could be about 300 PSI and the low side pressure 397 could be about 100 PSI.

Further, given the discussion thus far, it will be appreciated that, in general terms, an exemplary apparatus, according to another aspect of the invention, includes a mechanical refrigeration cycle arrangement in turn including an evaporator 102, a condenser 106, a compressor 104, and an expansion device 108, cooperatively interconnected. Also included are a drum 258 to receive clothes to be dried, an auxiliary heater 254, 254', a duct and fan arrangement (e.g., 252, 256, 260, 262) configured to pass air over the condenser and the heater, and through the drum, and a sensor (e.g., 110) located to sense high side temperature and/or high side pressure of the mechanical refrigeration cycle arrangement. In addition, a controller 112 is coupled to the sensor 110 and the auxiliary heater 254, 254', and is operative to activate the auxiliary heater during a startup transient of the mechanical refrigeration cycle arrangement; monitor the high side temperature and/or high side pressure, during the startup transient; and de-activate the auxiliary heater in response to the high side temperature and/or high side pressure reaching a first predetermined value corresponding to thermodynamic elevation of the mechanical refrigeration cycle arrangement consistent with a safe operating temperature of the compressor.

In some instances (e.g., as described with respect to FIG. 9), the controller is further operative to: monitor the high side temperature and/or high side pressure of the mechanical refrigeration cycle arrangement, during steady-state operation thereof; and periodically re-activate the auxiliary heater during the steady-state operation, responsive to the high side temperature and/or high side pressure declining to a second predetermined value, to at least partially maintain the thermodynamic elevation of the mechanical refrigeration cycle arrangement consistent with the safe operating temperature of the compressor, during the steady-state operation.

In a preferred but non-limiting approach, the monitoring is carried out with a sensor 110 located in a mid-point region of the condenser 106 of the mechanical refrigeration cycle.

In some instances, the first predetermined value is correlated to an upper safe temperature value for lubricating oil of the compressor (for example, about 220 degrees Fahrenheit, as discussed above).

In some instances, the thermodynamic elevation of the mechanical refrigeration cycle is such that both the high side pressure 399 and the low side pressure 397 of the mechanical refrigeration cycle are greater than an equilibrium pressure of the mechanical refrigeration cycle in off mode 302. For example, the high side pressure 399 could be about 300 PSI and the low side pressure 397 could be about 100 PSI.

Figure 10:
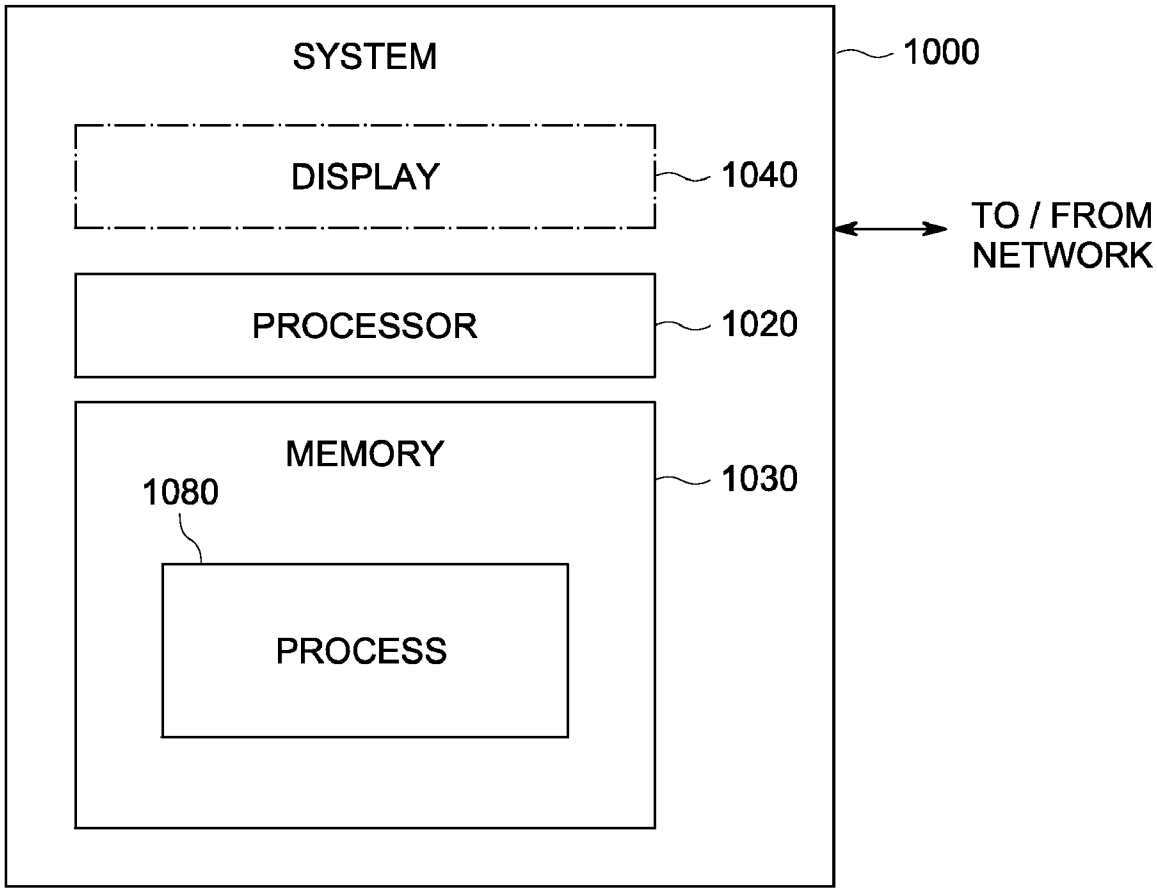
FIG. 10 is a block diagram of an exemplary computer system useful in connection with one or more embodiments of the invention.

Aspects of the invention (for example, controller 112 or a workstation or other computer system to carry out design methodologies) can employ hardware and/or hardware and software aspects. Software includes but is not limited to firmware, resident software, microcode, etc. FIG. 10 is a block diagram of a system 1000 that can implement part or all of one or more aspects or processes of the invention. As shown in FIG. 10, memory 1030 configures the processor 1020 to implement one or more aspects of the methods, steps, and functions disclosed herein (collectively, shown as process 1080 in FIG. 10). Different method steps could theoretically be performed by different processors. The memory 1030 could be distributed or local and the processor 1020 could be distributed or singular. The memory 1030 could be implemented as an electrical, magnetic or optical memory, or any combination of these or other types of storage devices. It should be noted that if distributed processors are employed (for example, in a design process), each distributed processor that makes up processor 1020 generally contains its own addressable memory space. It should also be noted that some or all of computer system 1000 can be incorporated into an application-specific or general-use integrated circuit. For example, one or more method steps (e.g., involving controller 112) could be implemented in hardware in an ASIC rather than using firmware. Display 1040 is representative of a variety of possible input/output devices. Examples of suitable controllers have been set forth above. In some instances, a controller is provided to transform a temperature or pressure signal into a comparative decision and power switch. In some embodiments, coefficients of a regression of data observed during experimentation to determine the appropriate switch point to sense in order to control can reside in memory and be used by the processor, in conjunction with the sensor (e.g., thermocouple, pressure transducer) signal, to provide a control signal.

As is known in the art, part or all of one or more aspects of the methods and apparatus discussed herein may be distributed as an article of manufacture that itself comprises a tangible computer readable recordable storage medium having computer readable code means embodied thereon. The computer readable program code means is operable, in conjunction with a processor or other computer system, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer to read instructions and data, such as magnetic variations on a magnetic medium or height variations on the surface of a compact disk. The medium can be distributed on multiple physical devices (or over multiple networks). As used herein, a tangible computer-readable recordable storage medium is intended to encompass a recordable medium, examples of which are set forth above, but is not intended to encompass a transmission medium or disembodied signal.

The computer system can contain a memory that will configure associated processors to implement the methods, steps, and functions disclosed herein. The memories could be distributed or local and the processors could be distributed or singular. The memories could be implemented as an electrical, magnetic or optical memory, or any combination of these or other types of storage devices. Moreover, the term "memory" should be construed broadly enough to encompass any information able to be read from or written to an address in the addressable space accessed by an associated processor. With this definition, information on a network is still within a memory because the associated processor can retrieve the information from the network.

Thus, elements of one or more embodiments of the invention, such as, for example, the controller 112 or a design workstation, can make use of computer technology with appropriate instructions to implement method steps described herein.

Accordingly, it will be appreciated that one or more embodiments of the present invention can include a computer program comprising computer program code means adapted to perform one or all of the steps of any methods or claims set forth herein when such program is run on a computer, and that such program may be embodied on a computer readable medium. Further, one or more embodiments of the present invention can include a computer comprising code adapted to cause the computer to carry out one or more steps of methods or claims set forth herein, together with one or more apparatus elements or features as depicted and described herein.

It will be understood that processors or computers employed in some aspects may or may not include a display, keyboard, or other input/output components. In some cases, an interface with sensor 110 is provided.

It should also be noted that the exemplary temperature and pressure values herein have been developed for Refrigerant R-134a; however, the invention is not limited to use with any particular refrigerant. For example, in some instances Refrigerant R-410A could be used. The skilled artisan will be able to determine optimal values of various parameters for other refrigerants, given the teachings herein.

Thus, while there have shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method comprising the steps of:

activating an auxiliary heater in one of a supply duct and a return duct of a heat pump clothes dryer operating on a mechanical refrigeration cycle, during a startup transient of said heat pump clothes dryer;

monitoring at least one of high side temperature and high side pressure of said mechanical refrigeration cycle, during said startup transient; and de-activating said auxiliary heater in response to said at least one of high side temperature and high side pressure reaching a first predetermined value corresponding to thermodynamic elevation of said mechanical refrigeration cycle consistent with a safe operating temperature of a compressor of said mechanical refrigeration cycle.

2. The method of claim 1, wherein, in said activating step, said auxiliary heater is located in said supply duct.

3. The method of claim 1, wherein, in said activating step, said auxiliary heater is located in said return duct.

4. The method of claim 1, further comprising:

monitoring said at least one of high side temperature and high side pressure of said mechanical refrigeration cycle, during steady-state operation of said heat pump clothes dryer;

periodically re-activating said auxiliary heater during said steady-state operation of said heat pump clothes dryer, responsive to said at least one of high side temperature and high side pressure declining to a second predetermined value, to at least partially maintain said thermodynamic elevation of said mechanical refrigeration cycle consistent with said safe operating temperature of said compressor of said mechanical refrigeration cycle, during said steady-state operation of said heat pump clothes dryer.

5. The method of claim 1, wherein said monitoring comprises monitoring with a sensor located in a mid-point region of a condenser of said mechanical refrigeration cycle.

6. The method of claim 1, wherein said first predetermined value is correlated to an upper safe temperature value for lubricating oil of said compressor.

7. The method of claim 6, wherein said upper safe temperature value for said lubricating oil of said compressor is about 220 degrees Fahrenheit.

8. The method of claim 1, wherein, in said de-activating step, said thermodynamic elevation of said mechanical refrigeration cycle is such that both said high side pressure and a low side pressure of said mechanical refrigeration cycle are greater than an equilibrium pressure of said mechanical refrigeration cycle in an off mode thereof.

9. The method of claim 8, wherein said high side pressure is about 300 PSI and said low side pressure is about 100 PSI.

10. An apparatus comprising:

a mechanical refrigeration cycle arrangement in turn comprising an evaporator, a condenser, a compressor, and an expansion device, cooperatively interconnected;

a drum to receive clothes to be dried;

an auxiliary heater;

a duct and fan arrangement configured to pass air over said condenser and said heater, and through said drum;

a sensor located to sense at least one of high side temperature and high side pressure of said mechanical refrigeration cycle arrangement; and a controller coupled to said sensor and said auxiliary heater, said controller being operative to:

activate said auxiliary heater during a startup transient of said mechanical refrigeration cycle arrangement;

monitor said at least one of high side temperature and high side pressure, during said startup transient; and de-activate said auxiliary heater in response to said at least one of high side temperature and high side pressure reaching a first predetermined value corresponding to thermodynamic elevation of said mechanical refrigeration cycle arrangement consistent with a safe operating temperature of said compressor.

11. The apparatus of claim 10, wherein said duct and fan arrangement comprises a supply duct and a return duct, and wherein said auxiliary heater is located in said supply duct.

12. The apparatus of claim 10, wherein said duct and fan arrangement comprises a supply duct and a return duct, and wherein said auxiliary heater is located in said return duct.

13. The apparatus of claim 10, wherein said controller is further operative to:

monitor said at least one of high side temperature and high side pressure of said mechanical refrigeration cycle arrangement, during steady-state operation thereof; and periodically re-activate said auxiliary heater during said steady-state operation, responsive to said at least one of high side temperature and high side pressure declining to a second predetermined value, to at least partially maintain said thermodynamic elevation of said mechanical refrigeration cycle arrangement consistent with said safe operating temperature of said compressor, during said steady-state operation.

14. The apparatus of claim 10, wherein said sensor is located in a mid-point region of said condenser.

15. The apparatus of claim 10, wherein said first predetermined value is correlated to an upper safe temperature value for lubricating oil of said compressor.

16. The apparatus of claim 15, wherein said upper safe temperature value for said lubricating oil of said compressor is about 220 degrees Fahrenheit.

17. The apparatus of claim 10, wherein said thermodynamic elevation of said mechanical refrigeration cycle arrangement is such that both said high side pressure and a low side pressure of said mechanical refrigeration cycle are greater than an equilibrium pressure of said mechanical refrigeration cycle in an off mode thereof.

18. The apparatus of claim 17, wherein said high side pressure is about 300 PSI and said low side pressure is about 100 PSI.

* * * * *